US006013140A

United States Patent [19]

Simoneaux

[11] Patent Number: 6,013,140

[45] Date of Patent: Jan. 11, 2000

[54] LASER HARDENING OF SCREW FORMS

[76] Inventor: Bret Simoneaux, 8471 Plantation Way, Harrisburg, N.C. 28075

[21] Appl. No.: 08/901,552

[22] Filed: Jul. 28, 1997

[51] Int. Cl.[7] ..... C22C 38/00

[52] U.S. Cl. ..... 148/320; 148/902; 415/71; 415/72; 415/73; 415/75; 415/120; 415/143

[58] Field of Search ..... 148/902, 320; 415/71, 72, 73, 75, 143, 120

[56] References Cited

U.S. PATENT DOCUMENTS

| | | | |
|---|---|---|---|
| 3,693,842 | 9/1972 | Cozzarin et al. | 222/195 |
| 4,502,273 | 3/1985 | Miyamoto et al. | 57/414 |
| 5,131,957 | 7/1992 | Epstein et al. | 148/565 |
| 5,330,587 | 7/1994 | Gavigan et al. | 148/212 |
| 5,601,414 | 2/1997 | DiRe | 417/44.2 |
| 5,719,376 | 2/1998 | Snyder et al. | 219/121.85 |

FOREIGN PATENT DOCUMENTS 63-212084 9/1998 Japan .

OTHER PUBLICATIONS

Weber, Tim,Hardening of Steel With a High Power CW Nd:YAG Laser, Proceedings of ICALCO '92 Laser Materials Processing, Oct. 25–29, 1992, Orlando Florida, 1993, pp. 3201–3208.

*Primary Examiner*—John Sheehan

[57] ABSTRACT

A harden screw form and methods of making same for use with, for example, positive displacement rotary axial screw pumps are disclosed. The methods include the use of a CNC machine with a laser and a special, newly developed optic for selectively hardening the contact areas of screw forms, such as for example, rotors used in positive displacement rotary axial screw pumps such that the rotor undergoes only controllable or predictable distortion as a result of the hardening process. Hardened screw forms manufactured by the CNC/laser/optic process that are free of uncontrollable or unpredictable distortion are also disclosed.

6 Claims, 4 Drawing Sheets

LASER HARDENING OF SCREW FORMS

BACKGROUND OF THE INVENTION

The present invention is generally directed to methods for reducing the distortion or dimensional variation in screw forms after heat treating and to screw forms having the reduced distortion or dimensional variations, more particularly to methods for hardening selected surface areas of screw forms and to screw forms hardened by the methods and, most particularly, to methods for hardening the contact zones of screw forms for use as rotors in positive displacement rotary axial screw pumps using a laser source and an optic and to rotors hardened by a laser source and an optic.

A standard screw pump operating under ideal conditions of pressure, fluid viscosity, and rotating speeds does not require hardened rotors to operate satisfactorily. When the pump is operated with thin fluids, at low speeds, at high pressures, or with contaminated fluids, hardening of the screw forms negates some adverse effects that these conditions can cause. Because prior standard processes for hardening screw forms required high temperatures up to about 1075° F. to the entire mass of the screw forms, these prior processes sometimes caused unacceptable distortion of the screw form. In one specific prior standard process for hardening screw forms, the screw forms were first subjected to an air bath at about 750° F.; then subjected to a first liquid bath at about 1075° F.; then from the first liquid bath to a second liquid bath at about 750° F.; then to a third liquid bath at room temperature with the third liquid bath at room temperature being followed by a fourth liquid bath at about 750° F. which was, in turn, followed by a final liquid bath at room temperature. Each of these temperature changes represents a potential dimensional stability problem in the finalized screw form. In this application, the term "distortion" is defined as a change in physical dimension of a screw form or other body that cannot be controlled or predicted.

Various methods are presently used to harden screw forms and include gas nitriding, induction hardening, carbonitriding and liquid nitriding, for example, being some of the more common methods. The gas nitriding and induction hardening methods required machining of the screw form after the completion of the hardening process. To minimize machining operations, liquid nitriding was used after all machining processes have been completed.

Recently a manufacturer of screw forms spent considerable time and effort to ensure that the quality of the power rotors produced for rotary screw pumps were of the highest quality and accuracy achievable. Most of these efforts were focused on medium or elementary dimensional variations due to changes in rotor lead (lead being defined as the measure of length that it takes one thread to complete one revolution, or 360°, around a part) and run out (run out being defined as a composite tolerance used to control the functional relationship of one or more features of a part to a datum axis) issues. Run-out is a standard term used to describe the amount that a surface varies from being perfectly circular about a particular axis. While variations in lead and increased run-out that can be induced due to several variables in several processes were eliminated or at least controlled, the one variable that was not reduced or eliminated was the distortion effect of the heat treating process on the screw forms. During the screw form manufacturing process, the hardening process had been considered a distortion free process, but differences in material from lot to lot, and from location on each bar (center to end) were found to react differently to the liquid nitride hardening process.

Screw form distortion was mainly seen in changes to the lead of the threaded section and run-out in various diameters of screw forms. The presence or absence of distortion in the hardened screw forms has been found to be a key to screw pump performance and consistency. To meet the competitive requirements of screw pump manufacturing, screw form distortion must be eliminated or at least reduced and controlled during the screw form manufacturing process.

Because of the geometry of the screw form or rotor thread, it was found to be impossible to accurately predict the end result of the liquid nitriding process, but experience showed unacceptable variation or distortion in the final part. This unacceptable variation was found in leads, run-out, and certain physical dimensions of the final hardened screw forms.

Through the years some work was done to determine the sizes and leads to manufacture on various rotor sizes to account for the changes that occur during the liquid nitriding hardening process. This has proven to be a never ending task as each lot of material responds slightly differently and is, thus, not consistent or predictable. The known method of manufacturing parts to one dimension to achieve a different dimension after being heat treated for compensation for sizes and leads has had no measurable effect on the run-out of the screw form or rotor after the liquid nitriding process was completed. Because run-out variation is not a growth but a distortion, it has not been predicted or controlled. It was believed the major cause of run-out distortion was the rapid temperature changes the screw form or rotor must go through during the liquid nitride hardening process. These temperature changes occur to the entire mass of the rotor and, thus, affect the entire shape of the rotor. As mentioned above, the liquid nitriding hardening method had previously been considered to be a distortion free hardening method for screw forms, such as, for example, rotors. However, because of the exacting tolerances required to produce screw forms to tight specifications for use with, for example, low noise screw pumps, the small amount of distortion that normally occurred during the liquid nitriding hardening process caused the screw forms to be uncontrollably and unpredictably out of the specified tolerances.

It is known that variation in screw form geometry or dimensions can be induced by the heat treating process and can cause distortion or dimensional variation in screw forms and, as a result, has adversely imparted the performance of screw pumps having the screw form therein in several areas. For screw pump rotors, these distortions or dimensional variations have been known to cause excessive backlash or interference in the mechanical system, excessive noise, shortened system life expectancy and higher system mechanical loss. When a screw form having out of tolerance dimensional variation is used in a screw pump, screw pump performance in the area of flow rate, power requirements, pump life, and noise level deteriorates.

Wide variations in these areas of screw pump performance have led to the requirement that screw pumps be rated to encompass a wider range of performance. This typically means that all screw pump ratings are very conservative when compared to the average screw pump for a specific application. As customers have become more aware of the need for optimizing screw pump performance to meet their system application requirements such as, for example, elevator applications, it has become important that the screw pump ratings become more accurate and approach a mean performance that meets the specific customer application specifications.

In the past, programs to eliminate as much manufacturing variation as possible in screw pumps were initiated. Some improvements were made in the design of the screw pump itself. Drawings were changed to a "Functional" method to minimize tolerance stack-up without tightening tolerances. Design modifications were made to reduce the number of variables that affect noise performance. Areas of manufacturing were also evaluated to determine specific operations that cause variation in screw pump parts. Because of these evaluations, the liquid nitriding hardening process was identified as the largest contributor to dimensional variation of the power rotor and as a major contributor to screw pump performance variation.

Thus, one key for reducing screw pump performance variation was to eliminate the pump to pump dimensional variation in the functioning elements of the screw pump. As used in this application, functioning elements are defined as those components that influence screw pump performance by directly impacting the fluid flow pattern and mechanical dynamics of the screw pump. By reducing the dimensional variation in the functioning elements, screw pump performance can be optimized and rated performance values more precisely defined.

One obvious solution might be to eliminate the heat treating process for screw forms. However, certain applications require hardened screw form rotors because of prior adverse experiences with soft screw form rotors. For this reason, a method that provides a hardened surface equal to or better than the current liquid nitriding process is required. This method would need to provide the hardness required while eliminating or at least significantly reducing, the degree of uncontrollable or unpredictable screw form distortion produced in the screw form rotor during the liquid nitride hardening process.

Another possible solution was to utilize a laser beam to heat treat the screw form surface. Numerous articles and technical reports have been written identifying laser heat treating as a possible method for hardening specific surfaces. The laser heat treating process was believed to be stable because of the localized temperature gradient. Since the entire mass of the screw form is not heated by the laser, the other material around the heat treated area helped stabilize the geometry or dimensions of the screw form as well as acting as a heat sink to control the rate of the temperature changes within the screw form. However, no laser heat treating process or any other process is known to have definitively demonstrated the capability for controlling screw form distortion and to sufficiently harden the power rotor. Specifically, no heat treated, hardened screw form, such as, for example, a power rotor, had been known to acceptably minimize screw form distortion and lead variations and to pass a 2,000 hour pump endurance test at about 900 psi.

Thus, there is a need for methods for reducing distortion or dimensional variations in screw forms and for screw-forms produced thereby, such as, for example, rotors used in screw pumps, which overcome the deficiencies listed above. Specifically, such methods should provide for screw form hardened contact zones; should significantly reduce distortion in the screw forms after the screw form hardening process; should improve the performance of screw pumps using the hardened screw forms; should provide for more precise, narrow performance rating of the screw pumps having the hardened screw forms; should decrease the manufacturing cost for hardening the screw forms; should reduce the noise level for screw pumps using the hardened screw forms; and should provide for improved operational life of screw pumps using the hardened screw forms.

SUMMARY OF THE INVENTION

One object of the present invention is to provide methods for hardening screw forms that minimize screw form distortion thereby enabling the final hardened screw form to be more consistent and, therefore, provide for the optimization of the application utilizing the screw form and screw forms produced by the methods.

This object is achieved by employing a combination of laser energy and a specialized optic with a CNC machine to achieve optimal screw form hardening and minimal screw form distortion. By applying the laser energy beam along a length or along a selected area of the screw form, the contact zones of a screw form can be hardening in a short period. In accordance with the preferred method of the present application, the laser energy imparts hardness to only the areas that require the hardened material properties and does not effect the entire mass of the screw form, as does the liquid nitride hardening process.

One method for making a hardened screw form includes the steps of: providing at least one screw form; providing at least one integrator optic; providing a computer numerical control machine for positioning the screw form and the integrator optic relative to each other; positioning the at least one screw form in the CNC machine; positioning the at least one integrator optic in the CNC machine; providing a laser for generating a laser beam; directing the laser through the integrator optic such that the laser beam impacts at least one portion of the screw form; and heating the at least one selected portion of the screw form such that after heating the screw form has a minimal change in dimensional characteristics.

In one embodiment, the laser hardened screw form of the present invention includes a metal member having a thread form operatively formed therein, the thread form having a root diameter, flanks and an outer surface; and at least the surfaces of the thread form root diameter being sufficiently hardened by laser energy without causing uncontrolled distortion of the screw form.

Other objects and advantages of the present application will become apparent from the following description, the accompanying drawings and the appended claims.

DETAILED DESCRIPTION OF THE INVENTION

The present invention is directed to methods for hardening the surfaces of screw forms, such as, for example, contact zones of rotors used in screw pumps using a laser source and a specialized optic. In the methods of the present invention, the laser produces the power required and the optic optimizes the energy pattern and the position of the laser energy pattern on the surface of the screw form to be hardened. The methods of the present invention provide for the hardening of the screw form surface in the screw form wear areas or contact zones and other areas as appropriate while significantly reducing screw form distortion or uncontrolled or unpredictable variations in the overall dimensional characteristics of the hardened screw form.

It has now been determined that laser hardening of screw form contact zones that would fatigue during operation has significantly reduced the screw form distortion problem because the hardening method of the present invention heats and hardens only the area of the screw form that requires hardening. Because the surrounding mass of the screw form or rotor is not directly heated, the physical shape of the selected area being heat treated is stabilized thereby maintaining the proper dimensional features of the screw form or rotor set within the specification required for use in screw pumps. To achieve this selective heat treating with the laser and optic, proper feed rates and power intensity are required. The proper feed rates and power intensity can be determined experimentally for different types of screw form materials and geometries. By significantly reducing distortion or dimensional variation in the hardened screw forms, the performance variation for the screw pumps using the screw forms was also reduced. The distortions caused by conventional heat treating had adversely affected flow rates, pump life, liquid borne noise levels, and air borne noise levels in a screw pump. The laser heat treating method of the present application provides a significant quality improvement in the overall performance of the screw pump having the laser hardened screw forms and for the systems that include the screw pump.

Figure 1:
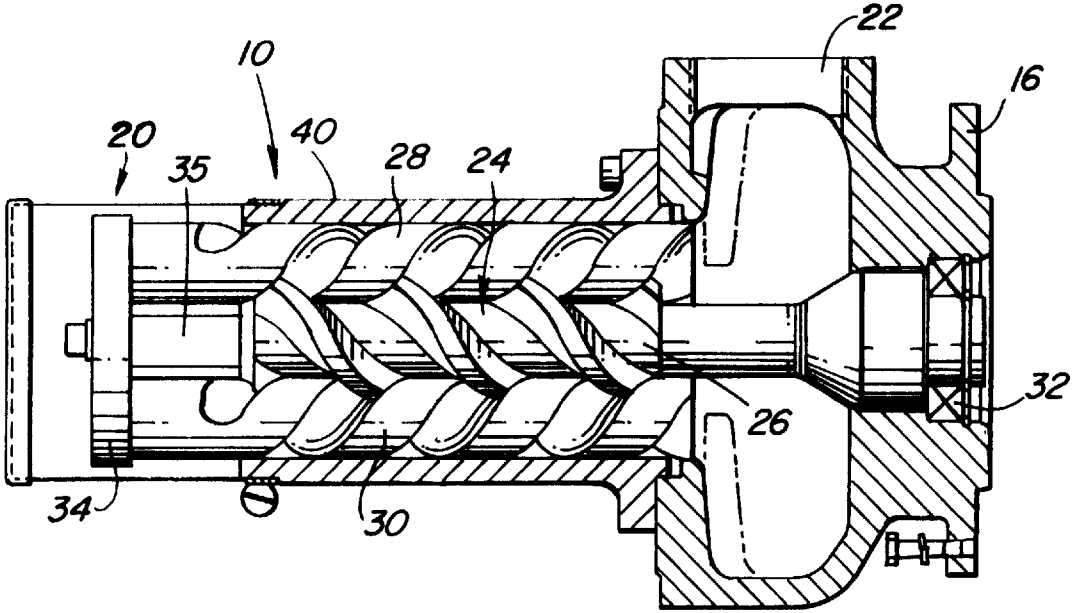
FIG. 1 is a sectional view of a representative rotary screw pump similar to the pumps useful with the present invention.

A representative rotary screw pump in which the hardened screw form of the present invention can be utilized is illustrated in FIG. 1. It should be understood that the rotary screw pump is only one possible pump which could benefit from the present invention and that many other pumps could also be used with the present invention, as is known in the art. The rotary screw pump 10 includes a screw portion.

The rotary screw pump shown, is similar to, but is not limited to, those commercially available from IMO Pump Division, P.O. Box 5020,Monroe, N.C. 28111-5020. The representative rotary screw pump 10 illustrated comprises a flange 16 for connecting to a motor (not shown), a housing 40, having an inlet 20 and an outlet 22 and a rotary screw mechanism 24 operatively positioned inside the housing 40. The rotary screw mechanism 24 comprises a precision ground and hardened power screw 26 and two precision ground, hardened idler rotors 28, 30. A positioning bearing 32, in fluid, is positioned proximate the flange 16. The positioning bearing could also alternatively be a bearing-free hydrostatic type bearing.

The rotary screw pump 10 works in a well known method to move fluid from the inlet 20 to the outlet 22. As shown, a thrustplate 34 is operatively connected to spacers 35 and the rotor housing 40.

Figure 2:
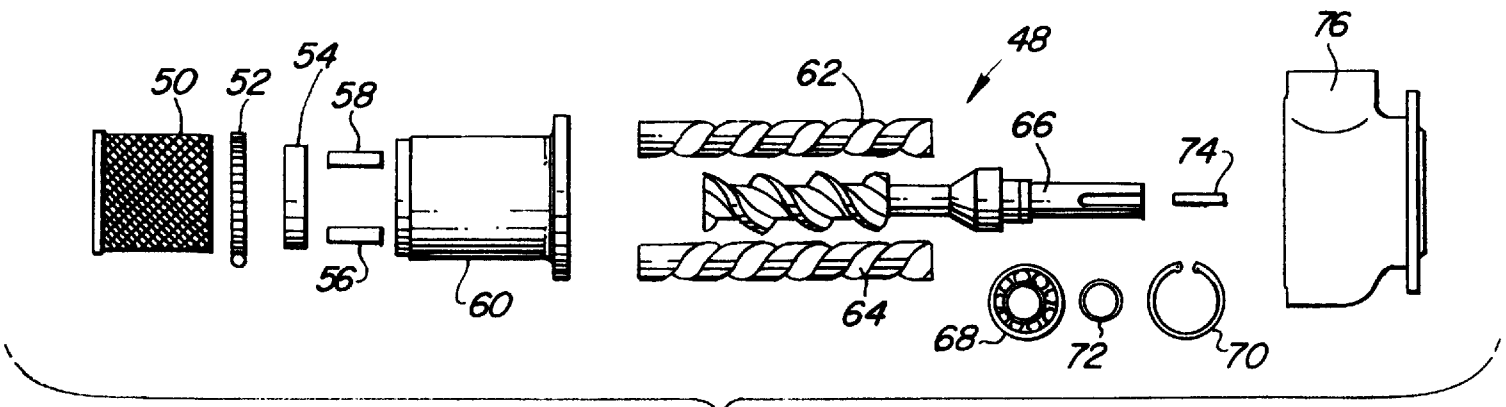
FIG. 2 is an exploded view of a representative axial screw pump.

FIG. 2 illustrates a representative rotary axial screw pump 48 of a type utilizing a screw form hardened by the methods of the present invention, as shown in an exploded view and typically includes an inlet screen 50, a clamp 52, a thrust plate 54, at least two spacers 56, 58, a housing member 60, two idler rotors 62, 64 and a power rotor 66. When assembled, the idler rotor 62, 64 and the power rotor 66 are encased in the housing 60 with a ballbearing 68 being operatively placed on the power rotor 66 and a pair of retaining rings 70, 72 and a key 74 being utilized to allow the motor to drive (couple) the power rotor 66. Finally, a cover 76 is placed over the other end for connection with a power source such as, for example, an electric motor (not shown).

Although a pumping set of screw form or rotors is shown in the figures, it should be understood that the hardening method of the present invention applies to any type of screw form, such as, for example, single screw pumps, two screw pumps, screw pumps with any number of rotors, worm gears, ball screws, and any other devices using screw mechanics.

In the representative rotary axial screw pump 48, the rotor set, which includes the power rotor screw 66 and two idler rotor screw forms 62, 64, has two contact zones within the meshing or area of contact between the screw forms of the rotor set. Because of the geometry of the threaded section of the screw forms or rotor set and the location of the wear that can occur to the rotors, the power rotor 66, defined as the rotor that is driven, is typically heat treated or hardened after all machining operations have been completed while the idler rotors 62, 64, defined as the rotors that are rotated by the power rotor, can be heat treated prior to the machining of the thread form. Laser hardening of only the contact zones or wear surfaces on the power rotor 66 provides for minimal distortion of the dimensional features of the power rotor, as compared to other hardening methods.

Figure 3:
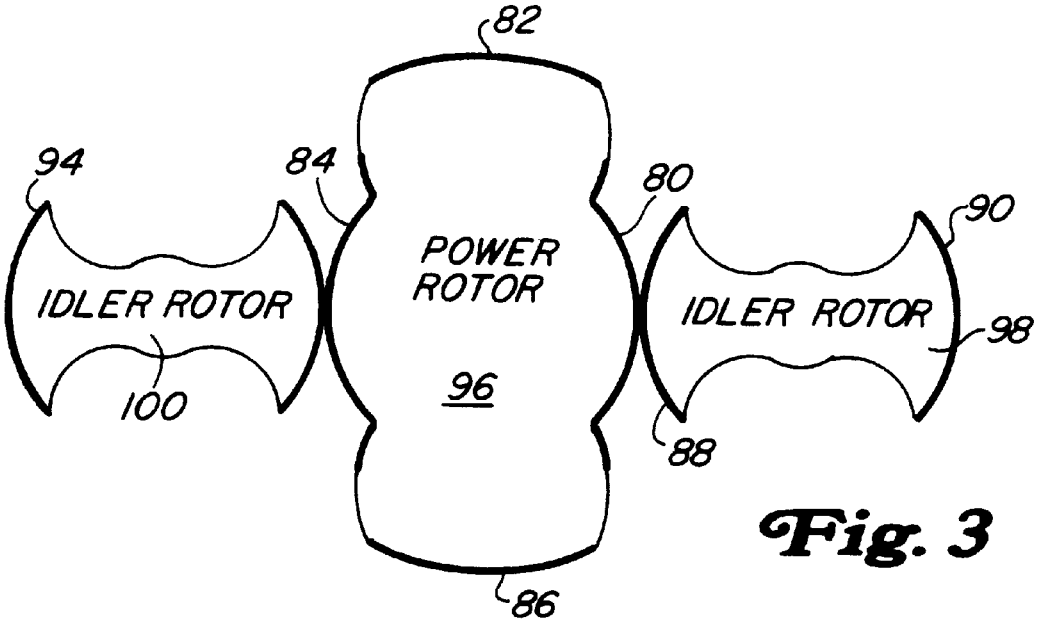
FIG. 3 is a sectional view of the rotor set of a representative axial screw pump.

The darkened areas 80, 82, 84, 86, 88, 90, 92, and 94 of the screw forms 96, 98, 100, as shown in FIG. 3, are the regions or contact zones where the screw forms, in this case a power rotor and two idler rotors, contact other surfaces. These contact zones are where wear and fatigue occur during normal pump operation having the hardening screw forms or rotors. Other screw form applications may entail different wear regions.

To reduce distortion or dimensional variation in the screw form while maintaining the properties of a hardened wear surface, it was discovered that a combination laser and optic system with a CNC machine could be used to apply laser energy directly to a selected localized area of the screw form in order to harden the surface of that selected localized area without distorting the physical geometry of the screw form itself. By controlling the power density of the laser, the screw form feed rates, and the optic focal length, screw forms can be hardened to specified requirements for a wide range of operating conditions.

Laser heat treating is known to be a quick and precise method of hardening metal surfaces. Basically, laser heat treating utilizes a very concentrated beam of laser energy in order to apply energy to a specific location on a metal surface. The power of the laser can be relatively low (1700 watts). By concentrating the power of the laser energy in a small area, the "power density" of the laser energy becomes great enough to quickly heat the prepared metal surface and to absorb the laser energy. This heating of the metal surface causes a change in the microstructure of the metal material resulting in a hardened form of the metal. For the development of the method of the present invention, a $CO_2$ laser was chosen because of its reliable history, availability of compatible hardware, and safety record.

To optimize the laser hardening process, it was determined that the absorption characteristics of the material to be heat treated was improved by darkening the surface prior to being heat treated by the laser. The darker surface was found to minimize the reflection of the laser light from the surface, thus optimizing the energy absorbed by the surface being heat treated as well as better controlling the rate of energy absorption. However, darker surface may not be required for certain types of lasers, such as, for example, a yttrium aluminum garnet (YAG) laser or ruby laser.

In order to harden selected portions of the screw form surface, the following methods were developed to prepare the screw form or rotor for absorbing the laser light. While, almost any method of darkening can be used, it has been determined that one key to successful heat treatment or hardening of screw forms is to have a uniform color and a clean surface. To reduce distortion or dimension variation in the final screw form, variations in surface color and clearness must also be eliminated or at least significantly reduced. Because of its ability to coat the part uniformly and maintain a clean surface, a black oxide coating process was chosen as the method of darkening the selected surface to be hardened.

As is known, laser energy can be routed, reflected, and adjusted to almost any shape and direction. The new optic used in the methods of the present invention transforms the round laser beam into the proper size and shape for hardening the screw form.

In order to optimize the benefits of heat treating a metal surface, a uniform depth below the metal surface is desired to minimize variation and distortion in the heat treated surface. As is also known, all optics are designed to create a precise pattern at a specific distance from the optic (focal length). Because screw forms have curved surfaces that require heat treatment, an approach to project the laser on the screw form surface being heat treated that best approximated a flat surface was desirable.

Figure 4:
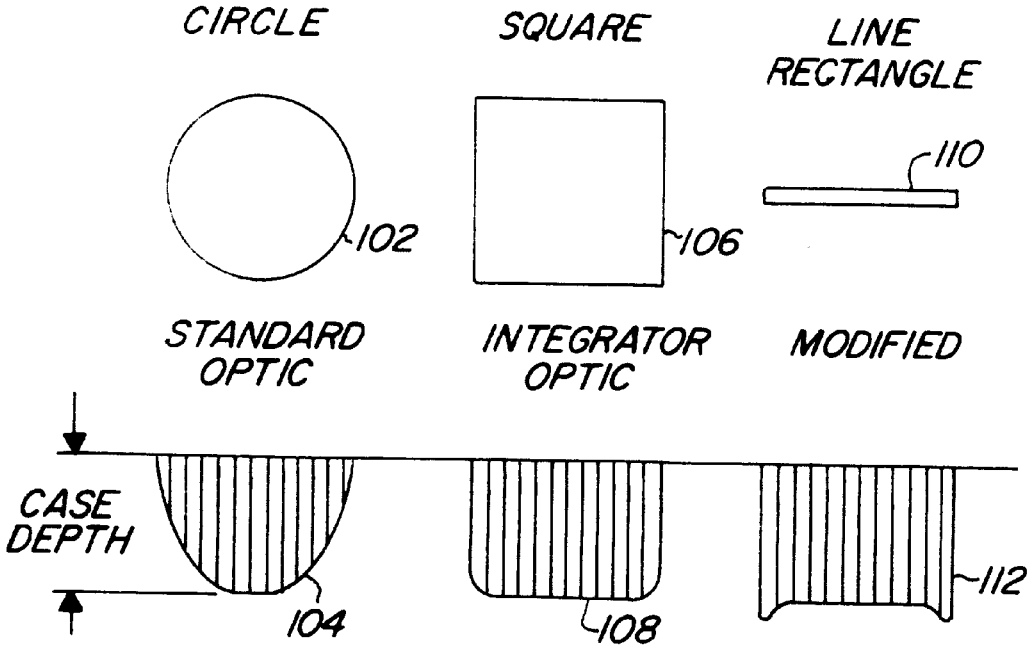
FIG. 4 is an illustration showing the optic pattern and the case depth for the representative optic pattern.

One standard optic used in laser heat treatment is a circle 102, as shown in FIG. 4, which projects a circular pattern onto the metal surface being heat treated. As this circular pattern travels along the metal surface, the location of the metal surface passing under the center of the circular pattern absorbs more energy than the location that passes under the edges of the circular pattern. As a result, the hardened section of the material varies in depth ("case depth") from one edge of the circle to the other edge. This type of profile produces a non-uniform case depth hardness. The non-uniform depth is caused by two specific qualities of the circular laser profile. First, as the laser beam travels along a path, the edges of the circular beam spend less time on the surface of the material than the centerline of the circular path. Second, the power density of the circular laser beam is stronger in the middle than at the edges. The variance in case depth produced by the circular optic was determined to be unacceptable for hardening of screw forms and the standard circular optic was eliminated from further consideration.

A laser beam integrator type lens or optic was used to develop a consistent case depth hardness for the entire contact zone. This is accomplished by changing the laser pattern from a circle to a square 106 and maintaining the power density throughout the entire profile. This method provided a more consistent hardening across a flat area.

Figure 5:
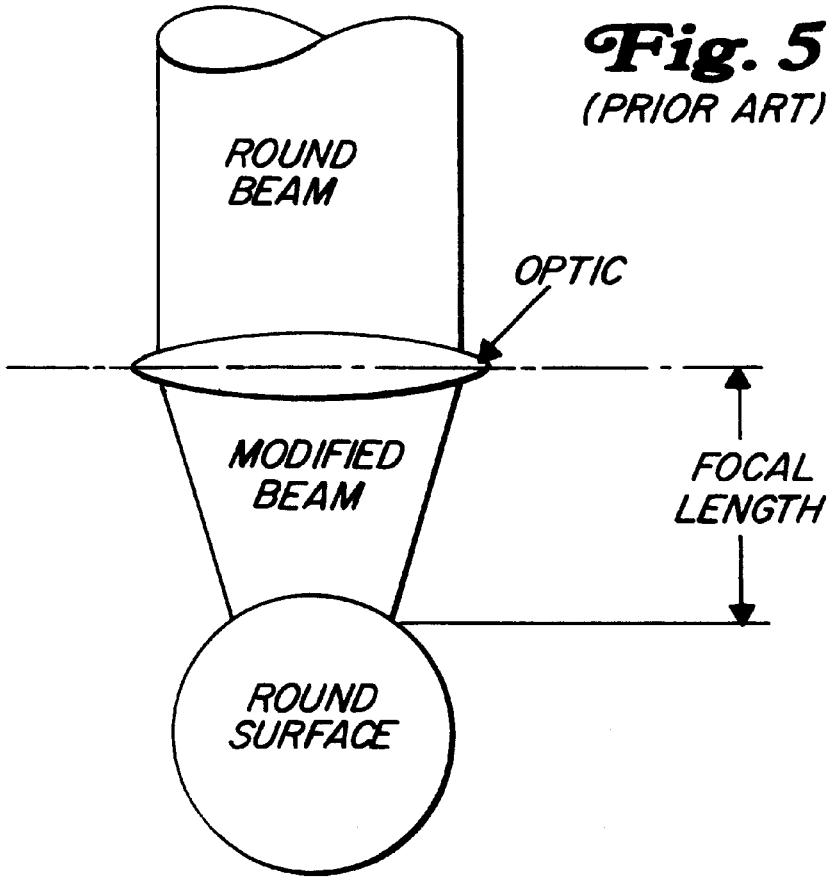
Fig. 5 (PRIOR ART)
FIG. 5 is a schematic illustrating the focal length of the pattern of a prior optic on a round surface.

The square integrated optic 106 was found to project a square pattern on the metal surface being heat treated or hardened and to eliminate the case depth variation experienced using a circular optic by ensuring that the material surface of the screw form that is exposed to the laser had a uniform amount of exposure time to the laser energy, as shown in FIG. 4. However, the square optic 106 experienced problems with maintaining a consistent focal length. As shown in FIG. 5, when focusing the laser energy on a round surface, only part of the surface is at the ideal focal length. This deviation in focal length leaves the remainder of the surface slightly out of focus and, thus, not ideal for the process. Unless the focal length (focal length being defined as the distance from the optic that the desired pattern is formed), of the optic was maintained consistently during the hardening process, the resulting hardened area was inconsistent and out of specification. Inconsistency of the hardened area resulted because, at other focal lengths, the laser beam pattern is different in size, shape and clarity at the point where it strikes the surface being hardened.

Finally, it was determined that the best results utilizing a beam integrating the laser are achieved when the beam is focused on the surface to be hardened at a fixed distance. Since the power rotor is a round part and the thread profile is not straight, a modification to the integrator lens was made in order to accommodate the curved thread profile of the screw form.

Figure 6:
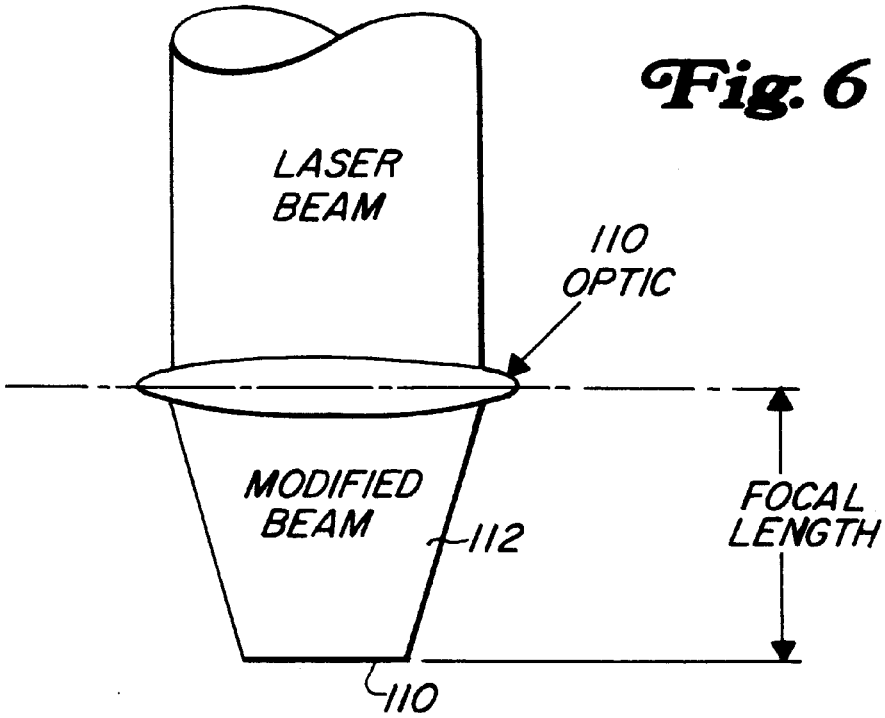
FIG. 6 is a schematic illustrating the focal length of the flat like pattern of the optic of the present application.
Figure 7:
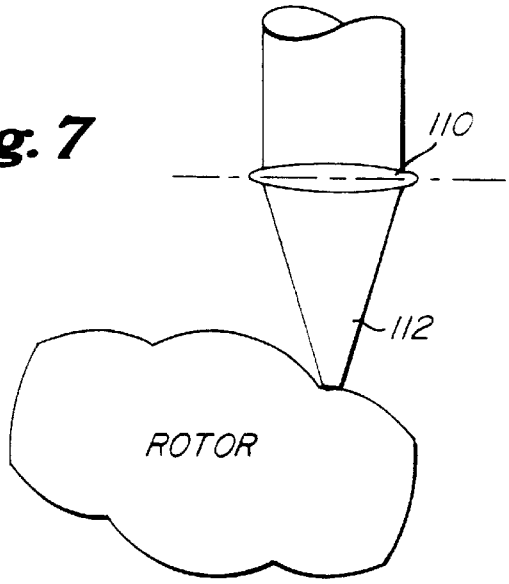
FIG. 7 is a schematic illustrating the flat like profile of the laser at the point of impact of the laser modified by the optic of the present application.
Figure 8A:
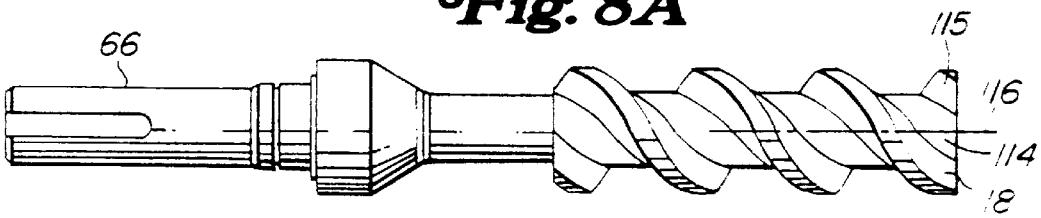
FIG. 8*a* is a view of a power rotor before laser hardening in accordance with the present invention.
Figure 8B:
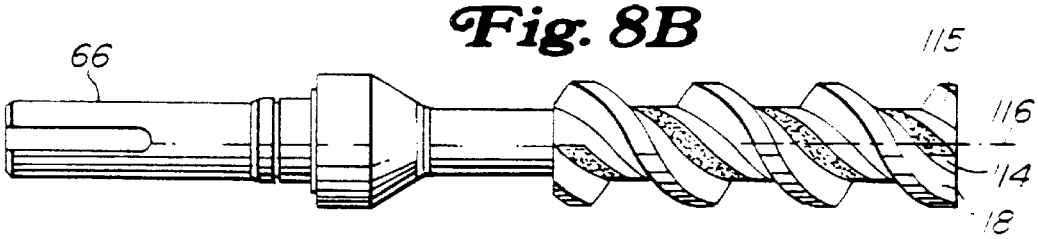
FIG. 8*b* is a view of the power rotor of FIG. 5*a* after the first laser pass on both of the root diameters of the thread form.
Figure 8C:
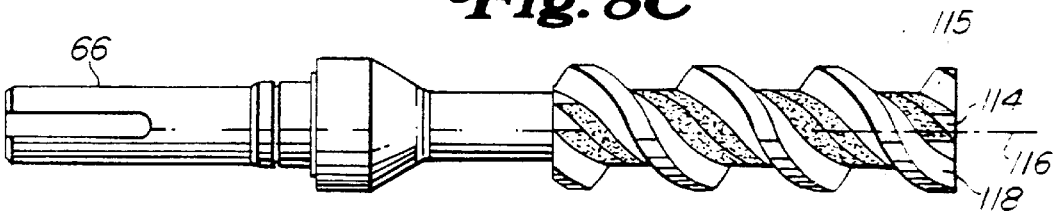
FIG. 8*c* is a view of the power rotor of FIG. 5*b* after the second laser pass on both of the root diameters of the thread form.
Figure 8D:
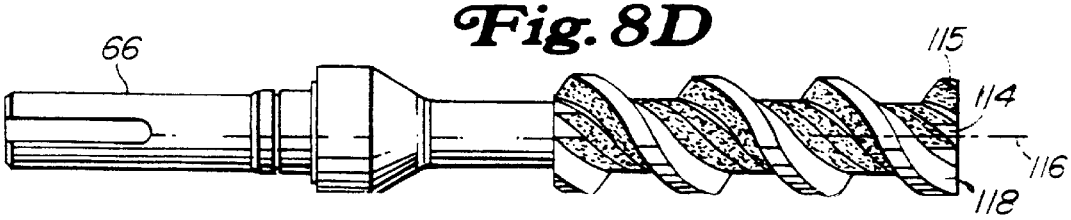
FIG. 8*d* is a view of the power rotor of FIG. 5*c* after the third laser pass on both flanks of the thread form.

The variation of the depth of hardening across the hardened area was minimized by using the integrated optic to form a rectangle that approaches a line 110, as shown in FIGS. 4 and 6. The integrator optic comprises a series of lens shapes that each take a portion of the round beam and reshape it to a small square. The squares are then positioned in a line and stacked onto each other to produce the desired line pattern. Basically, the line consists of a series of small squares to form a line. More than one square can be placed in a zone to increase the intensity of the line but to keep a uniform strength the same number of squares must be at each individual location. By using the rectangular/line optic 110 and rotating the resulting laser pattern 112 onto the rotor surface to be hardened, the laser energy beam was projected onto the rotor at a nearly uniform focal length throughout the heat treating process, as illustrated in FIGS. 7 and 8*a–d*. As shown, both root diameters 114 and both flanks 115 of the thread form 118 of the power rotor 66 can be hardened by the method of the present invention.

By changing the shape of the laser beam contact area on the surface of the screw form, the laser beam could be oriented on the root diameter 114 along the centerline 116 of the power rotor in order to provide a constant distance from the optic to the curved surface and then the beam was rotated 90° (See FIGS. 7 and 8*a–d*) and off-set to the thread form 118. Although the laser beam is not perfectly straight at this point, this position for the beam on the surface presented the least amount of height change or focal length change. The relative position of the laser and the optic are maintained using conventional CNC controls and mathematical relationships to the rotor profile. The rotor is first located in the proper position relative to the optic. The rotor is then rotated and traversed down its length at a rate that would maintain the geometry of the profile, as is known in the art. The laser beam is then oriented on the screw form flanks and the above described process is repeated in order to harden the flanks.

The case depth of the heat treated surface, such as, for example, the root diameter and/or the flanks of a screw form, is determined by the power of the laser, the duration of the laser beam on the surface and the absorption rate of the surface. It was determined that to achieve the desired results, sample runs must be made on each material and a cross section of the part having the hardened surface checked and verified for case depth. If adjustment was required, the process was repeated. Because of the consistency of the laser heat treat hardening method of the present invention, it was surprisingly easy to determine the proper technique for hardening the selected areas of the screw form while controlling distortion. While surface distortion can occur with laser heat treatment if too much energy is applied to a given area, the heat treatment would be at a much deeper case depth than is required by the screw pump application. As is known in the art, the case depth range and the point of distortion is material dependent.

It should be noted that one key to the method of the present invention is the rotation of the rectangular/line optic to run parallel to the screw form axis while the root diameter of the screw form is being exposed to the laser energy. The optic 110 can be rotated ninety (90°) degrees and off-set to achieve a near flat profile on the thread form 118 of the power rotor. Since the laser beam is projected to the optic as a circle, the optic can be turned to the desired orientation and then the screw form is offset by the necessary amount, as is known in the art.

Using this method, the laser produces the power required to heat treat the metal surface and the optic optimizes the laser energy pattern and the position that the laser energy impacts the surface of the screw form to be hardened. The method of the present invention provides for the effective and efficient hardening of the screw form in selected areas without distortion of the overall dimensional characteristics of the screw form, i.e., the dimensions of the screw after heat treatment, according to the methods of the present invention are within acceptable tolerances or are predictably controllable.

As mentioned above, the screw form to be heat treated needs to have a surface that is non-reflective. One method for making the surface to be heat treated non-reflective is the black oxide coating method. An example of a black oxide coating method that would be effective with the methods of the present invention is available from Birchwood Laboratories, Inc. 7900 Fuller Road, Eden Prairie, Minn. 55344.

Basically this method for making the metal surface non-reflective is a seven step process that applies a coating to the surface of the part being heat treated. Because this coating is black, it is ideal for absorbing the energy of the laser beam.

In one specific execution of the methods of the present invention, a screw form was heat treated by laser energy in accordance with the following example.

EXAMPLE

To determine the distortion due to different laser energy settings, the above method for producing a case depth of about 0.006 and about 0.012 was experimentally determined. Two sets of rotors were manufactured with these depths for evaluation. Because of the effect of the localized heat on the black oxide coating, a powdery substance was left on the power rotor. This substance was easily removed using a wire brush wheel. After this operation, the part was ready to be assembled in the pump and tested.

Two case depths were tested for dimensional geometry variation using a DSC200 power rotor made from E.S. 2.1.3.43 AISI C1144—MACSTEEL. These case depths were achieved by using a $CO_2$ type of laser source and the laser energy settings as shown below in Table I:

TABLE I

| | Case I 0.012" Case Depth | Case II 0.006" Case Depth |
|---|---|---|
| Laser Power | 1230 watts | 2000 watts |
| Lens | New Integrator | New Integrator |
| Focus | optimum | optimum |
| Nozzle Stand-off | 2" | 2" |
| Assist Gas | Nitrogen | Nitrogen |
| Gas Pressure | 10 psi | 10 psi |
| Process Speed | 36" per minute | 90" per minute |

Because the laser heat treating method effects only a portion of the power rotor material, less distortion to the rotor dimensional geometry was experienced. The rotors from both test cases were measured and found to have a run-out of about 0.0006 maximum deviation. The prior method of liquid nitriding is known to cause as much as about a 0.0020 dimensional run-out deviation. The difference between about a 0.0006 and about a 0.0020 run-out deviation provides a significant advantage for reducing overall screw pump dimensional variation and thus improving pump efficiency.

While using the laser heat treatment method, it was determined that the lead was consistently shortened by about 0.0002 inch (0.0003 Max & 0.0001 Min). With the lead change differential consistent, the lead change during the laser heat treating was easily corrected using a 'false lead' approach, as is known in the art. When compared to the liquid nitriding growth of up to about 0.0020 inch, this is a significant improvement.

A random power rotor was chosen from those produced according to the method of the present invention for use in a pump endurance test (Case II—0.006 case depth). A screw pump was assembled using the selected power rotor and a test was conducted at about 900 psi, about 100 SSU, and about 3560 rpm for about 2,000 hours. After completion of the test, the screw pump was disassembled and visually inspected for degradation. The area of the rotor hardened by the laser heat treatment method of the present invention showed no visible signs of wear. An area at the flank—OD intersection on the suction side showed removal of the black oxide coating, but no visible damage to the rotor itself.

As mentioned above, changes in screw form dimensional geometry are a major factor in screw pump performance variation. These screw form dimensional variations are known to cause shifts in screw pump performance that range from well over acceptable performance levels to well under acceptable performance levels. The laser hardening method of the present invention represents a significant advancement in reducing screw pump performance variations while maintaining the hardness required to insure that the screw pump will not fail in a plurality of applications such as, for example, elevator service. Additionally, it is believed that the laser hardening method of the present invention could be used in additional applications such as, for example, ball screws; compressor screws; fasteners; and worm gears, etc.

One significant advantage of laser hardening methods of the present invention is the dimensional consistency or lack of distortion produced from rotor to rotor. In the past, programs to eliminate as much manufacturing variation as possible in screw pumps had been conducted. Some improvements were made in the design of the screw pump itself. Drawings were changed to a "Functional" method to minimize tolerance stack-up without tightening tolerances. A design modification was made to reduce the number of variables that affect noise performance. Areas of manufacturing were also evaluated to determine specific operations that cause variation in the parts. As a result of these evaluations, the liquid nitriding process was identified as the largest contributor to dimensional variation of the power rotor.

End users have recently indicated that screw pump performance variation is a large concern. If screw form dimensional variations could be controlled, screw pump system performance would be optimized and potentially some elements removed. Specifically, because of the potential for elevated noise levels due to unacceptable pump performance variations, a muffler has been typically used to dampen the excess noise levels. Also, the vibrations induced by unacceptable pump performance variations, have caused a need for isolators to be used to prevent the induced vibrations from being transmitted to the surrounding environment. With the control of the screw form dimensional variations, the muffler and the isolators could be eliminated from some screw pump systems. Reduction of the distortion or the dimensional variations caused by the prior heat treating process represents a major improvement in screw pump performance variation for screw pumps used in elevator applications as well as other commercial applications.

Another key advantage resulting from the methods of the present invention is the fact that an operator manufacturing the screw forms or power rotors can receive feedback on the performance of the rotor prior to making an entire lot of screw forms, or rotors. This feedback alone provides several opportunities to optimize the various variables to produce an optimal power rotor thread form.

Laser hardening, in accordance with the present invention, can be utilized on power rotors that are used in applications of high pressure (400 psi/closure), high and low viscosity's, and high shaft speeds.

In accordance with the present invention, laser hardening has proved to be a viable solution to the rotor distortion problem while maintaining the desired surface hardness. Although other methods may produce similar results, the laser hardening method of the present invention provides consistent results with a minimum amount of operator time and effort thereby reducing manufacturing cost and improving the quality of screw forms, such as, power rotors used in screw pumps.

In summary, a positive displacement rotary axial screw pump was produced utilizing the laser heat treating methods of the present invention to heat treat a screw form or power rotor in order to minimize variation in pump performance while maintaining the pumps ability to efficiently function in a wide range of applications. The laser heat treat methods of the present invention have proven effective to minimize screw form distortion or dimensional variations in hardened screw forms and thereby significantly reduce, if not effectively eliminate, the primary cause of unacceptable performance variation in screw pump performance.

The methods of the present invention have three unique specific features. First, the methods utilize laser light to focus energy (heat) on very specific, well defined areas of the screw form surface geometry, specifically, that portion of the screw form that is in wear contact with mating surfaces of the contact zone of the adjacent or mating screw form. However, focusing of laser energy provides for the hardening of any surface area of the screw form that requires a hardened surface to be hardened including the outer surface of the thread form, as shown in FIGS. 8*a–d*.

Second, a specific new integrator optic was designed and developed for use with the methods of the present invention to project a very precise energy pattern for contacting the surface of a part or screw form having a complex geometry while maintaining a consistent case depth hardness across the entire energy pattern. Both of these features have been proven to make significant contributions to reducing dimensional distortion and variations in the finished rotor set.

Third, the methods of the present invention include the use of Computer Numerical Controlled (CNC) equipment to properly position the screw form relative the laser energy being focused on the surface of the screw form by the optic in order to ensure that the laser energy beam impinges the selected area of the screw form, to control the screw form feed rates and to control the laser power levels during the hardening process in order to control the case depth, among other parameters. All of these specific features are required for maintaining a consistent case depth throughout the length of the screw form being hardened and results in screw forms that have consistent dimensions within a tolerance of no greater than about 0.0005 inches from predetermined screw form dimensions.

Changes and modifications in the specifically described methods and embodiments can be carried out without departing from the scope of the invention that is intended to be limited only by the scope of the appended claims.

What is claimed is:

1. A laser harden screw form comprising:

a body having exterior surfaces defining a screw form including a root diameter and flanks and top surfaces of a thread form, the surface of the root diameter of the body having been surface-hardened by heat treatment using a beam of high energy radiation applied substantially momentarily to selected surface portions of the root diameter to harden the selected surface portions of the root diameter sufficiently to about a uniform depth below the metal surface such that there is no more than about 0.0006 dimensional run-out deviation of uncontrolled distortion of the screw form.

2. The screw form of claim 1 wherein the flanks have been surface-hardened by heat treatment using a beam of high energy radiation applied substantially momentarily to selected surface portions of the flanks to harden the selected surface portions of the flanks sufficiently to about a uniform depth below the metal surface such that there is no more than about 0.0006 dimensional run-out deviation of uncontrolled distortion of the screw form.

3. The screw form of claim 1 wherein the outer surface of the thread form has been surface-hardened by heat treatment using a beam of high energy radiation applied substantially momentarily to the outer surface of the thread form sufficiently to about a uniform depth below the metal surface such that there is no more than about 0.0006 dimensional run-out deviation of uncontrolled distortion of the screw form.

4. A screw form comprising:

a metal member having a thread form operatively formed therein, the thread form having a root diameter, flanks and an outer surface; and at least the surfaces of the thread form root diameter having been sufficiently hardened by laser energy to about a uniform depth below the metal surface such that there is no more than about 0.0006 dimensional run-out deviation of uncontrolled distortion of the screw form.

5. The screw form of claim 4 further comprising:

at least the surfaces of the thread form flanks having been sufficiently hardened by laser energy to a uniform depth below the mild surface such that there is no more than about 0.0006 dimensional run-out deviation of uncontrolled distortion of the screw form.

6. The screw form of claim 4 further comprising:

at least the surfaces of the thread form outer surfaces having been sufficiently hardened by laser energy to a uniform depth below the metal surface such that there is no more than about 0.0006 dimensional run-out deviation of uncontrolled distortion of the screw form.

* * * * *